United States Patent [19]

Suzuki et al.

[11] Patent Number: 4,826,035

[45] Date of Patent: May 2, 1989

[54] PRESSURE-REGULATING DEVICE FOR USE IN STORAGE, TRANSPORTATION AND DISPOSAL OF HAZARDOUS WASTES

[75] Inventors: Osamu Suzuki; Kanjiro Ishizaki; Akira Asami, all of Saitama; Shizuko Kushida, Tokyo, all of Japan

[73] Assignee: Chichibu Cement Co. Ltd., Tokyo, Japan

[21] Appl. No.: 46,280

[22] Filed: May 5, 1987

[30] Foreign Application Priority Data

May 12, 1986 [JP] Japan ..... 61-108336

[51] Int. Cl.[4] ..... B65D 51/16

[52] U.S. Cl. ..... 220/203; 220/373

[58] Field of Search ..... 220/203, 273; 176/68, 176/19 LD

[56] References Cited

U.S. PATENT DOCUMENTS 3,663,363 5/1972 Crouthamel et al. ..... 176/19 LD 3,846,235 11/1974 Jones et al. ..... 176/68

3,957,576 5/1976 Boyer et al. ..... 220/373

FOREIGN PATENT DOCUMENTS 3107611 9/1982 Fed. Rep. of Germany .

1146972 3/1969 United Kingdom .

*Primary Examiner*—George T. Hall

*Attorney, Agent, or Firm*—Browdy and Neimark

[57] ABSTRACT

A pressure-regulating device for impact-resistant containers used for storage, transportation and disposal of hazardous waste materials, is herein disclosed, which comprises a vent fixed to the lid of said container to keep the gaseous phase pressure inside said container at a positive pressure of 50% or less of the pressure resistance of said container, the vent being columnar and made of an alumina-based sintered ceramic and having a porosity of 50% or less, a pore diameter range of 0.4 to 1.4 $\mu$ and a length (mm)/cross-sectional area ($mm^2$) ratio of 2 to 10.

4 Claims, 3 Drawing Sheets

AN ELECTRON MICROGRAPH OF CERAMIC VENT IN CROSS-SECTION (MAGNIFICATION OF 1,150)

PRESSURE-REGULATING DEVICE FOR USE IN STORAGE, TRANSPORTATION AND DISPOSAL OF HAZARDOUS WASTES

BACKGROUND OF THE INVENTION

1. Field of the Invention

The present invention relates to a pressure-regulating device for containers used for storage, transportation and disposal of dangerous substances such as low- and medium-level radioactive wastes and industrial wastes.

2. Description of the Prior Art

With the continuous increase in the amounts of such wastes (1) various radioactive wastes generated from nuclear power plants and other nuclear facilities and (2) harmful heavy metal sludges issued from chemical plants, operators and researchers are making every effort to develop safe and economical ways to store, transport and dispose of these wastes.

Radioactive substances differ from heavy metals in that individual nuclides have their own half-lives and need to be isolated from the biosphere for limited periods. In the current nuclear fuel cycle that involves nuclear fission, most of the long-lived wastes originate from the spent fuel reprocessing plants. Beta- and gamma-emitting radioisotopes such as $^{90}Sr$ and $^{137}Cs$ have half-lives of several hundred years, and alpha-emitting transuranics having atomic numbers of 93 or more have estimated half-lives of hundreds of thousands of years. These radioisotopes are typically discharged as high-level radioactive wastes. It is considered that they should first be stored temporarily as liquids, then solidified by suitable methods and stored by utilizing various engineering techniques and finally disposed of. Intermediate- and low-level wastes of low concentration, however, are discharged in far greater amounts than high-level wastes and it is generally understood that their half-lives are not more than about a hundred years. In other words, ideal containers for land storage of low- and intermediate-level radioactive wastes should confine them safely for at least about a hundred years.

Many containers to be used for storage, transportation and disposal of intermediate- and low-level radioactive wastes are currently being or have been proposed.

One of such containers is a high integrity container in actual use wherein a concrete reinforced with steel fiber, wire netting or the like is strongly bonded to the inner surface of a metal container with an impregnant such as a polymer or an inorganic substance (this concrete is hereinafter referred to as SFPIC) hereby the long-term durability and easiness of handling are improved and the reduction of the internal volume is minimized.

Containers used for storage, transportation and disposal of radioactive wastes, industrial wastes, etc. have experienced, during he period of storage, transportation and disposal, problems of container expansion or breakage caused by gas generation due to the chemical reaction of the contents and by the resulting increase in gas pressure inside the container. In order to structurally protect the containers from such problems, it is required that the internal pressure of the container be kept at a positive pressure of 50% or less of the pressure resistance of the container by an appropriate means, that the means has sufficient durability, that the inflow of water into the container through the means be 0.1% or less of the internal volume of the container over 100 hours even when the container is subjected to a hydraulic pressure corresponding to the water head at the depth at which the container is to be buried, and that the means will not break or part company with the container or damage it in any way even in the event that the container is dropped due to an accident.

SUMMARY OF THE INVENTION

It is therefore an object of the present invention to provide a pressure-regulating device for impact-resistant containers used for storage, transportation and disposal of hazardous wastes, which comprises a vent fixed to the lid of the container.

Other objects and advantages of the present invention will become apparent to those skilled in the art from the following description and disclosure.

DETAILED DESCRIPTION OF THE PREFERRED EMBODIMENT

Figure 1:
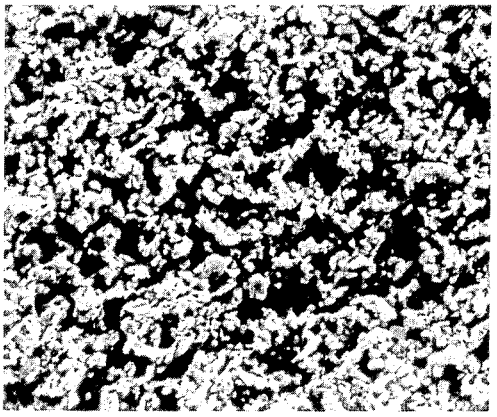
FIG. 1 is an electron micrograph of ceramic vent in cross-section at a 1,150× magnification.

The present invention relates to a vent made of an alumina-based sintered ceramic fixed to the lid portion of such a container acts as a satisfactory pressure-regulating device and meets the above requirements.

The pressure-regulating device of the present invention for containers used for storage, transportation and disposal of radioactive wastes, industrial wastes, etc. is a vent fixed to the lid portion of said container to keep the gaseous phase pressure inside said container at a positive pressure of 50% or less of the pressure resistance of said container, the vent being columnar and made of an alumina-based sintered ceramic and having a porosity of 50% or less, a pore diameter range of 0.4 to 1.4 $\mu$ and a length (mm)/cross-sectional area ($mm^2$) ratio of 2 to 10.

When the porosity of the pressure-regulating device is higher than 50%, water comes into the container more easily through the device. Also when the length/cross-sectional area ratio of the device is smaller than 2, water comes into the container more easily. When the ratio is larger than 10, the gas inside the container cannot easily escape through the device.

Measurement of porosity was conducted with a mercury injection type apparatus, Autopore 9200 type, made by Shimadzu Corp. by obtaining the mercury pressure injection volume of feed samples wherein mercury was injected under pressure of 0 to 60,000 psia.

In preferred embodiments of the present invention, the vent is made of an alumina-based sintered material consisting of 92 to 95% of $Al_2O_3$, 4.5 to 7% of $SiO_2$, with the balance consisting of other components. Other ceramic materials and organic materials can be used depending upon the purpose of application of the vent.

The columnar vent can have various cross-sectional shapes such as square, hexagonal, octagonal and circular and an appropriate cross-sectional shape can be selected so as to best meet the purpose.

A preferred pore distribution of the vent is shown in Table 1.

TABLE 1

| Pore diameter (μ) | Pore volume (%) |
|---|---|
| 1.0 to 0.8 | 48 |
| 0.8 to 0.6 | 30 |
| 0.6 to 0.5 | 11 |
| 0.5 to 0.4 | 6 |
| others | 5 |

The other properties of the vent are shown below.

| | |
|---|---|
| Bending strength | 450 kg/cm$^2$ or more |
| Bulk specific gravity | 2.20 |
| Thermal expansion coefficient | 7.4 × 10$^{-6}$/°C. (room temp. to 800° C.) |
| Fire resistance | 1800° C. |
| Chemical resistance | stable except for alkalis and hydrofluoric acid |

For the preferred embodiments of the vent of the present invention, description is given below of (1) shape and dimension, (2) fixation, (3) capability test, (4) test for confirmation of safety after the vent has been subjected to a hydraulic pressure and (5) dropping test.

(1) Shape and dimension of vent (a) The vent has the shape of a quadrangular prism and a dimension of 3×3×1 mm.

(b) The length (l) of the vent is 38 mm for 200-liter containers and 45 mm for 400-liter containers.

(2) Fixation of vent (a) Make a hole 7 mm in diameter in the lid.

(b) Thoroughly clean the hole (c) A sponge rubber is placed on the upper side of the lid, and they are both turned upside down.

(d) An epoxy resin is poured into the hole.

(e) A vent 2 to 4 mm longer than the thickness of the lid is inserted into the hole filled with the epoxy resin in such a way that the lower end of the vent projects from the sponge rubber by 1 to 2 mm and the upper end of the vent projects from the lid by 1 to 2 mm.

(f) After the epoxy resin has cured, the portions of the vent projecting from the two sides of the lid are shaved off with a grinder so that both ends of the vent are flush with the surfaces of the lid.

(3) Test for capability of vent (A) Test purpose

To confirm the capability of a ceramic vent in regard to gas release and water shielding.

(B) Test method (a) A vent was fixed to the center of a SFPIC sample 190 mm in diameter and 38 or 45 mm in thickness simulating a container lid. They were incorporated into the apparatuses of FIGS. 2 and 3. Then, the following tests were conducted.

Figure 2:
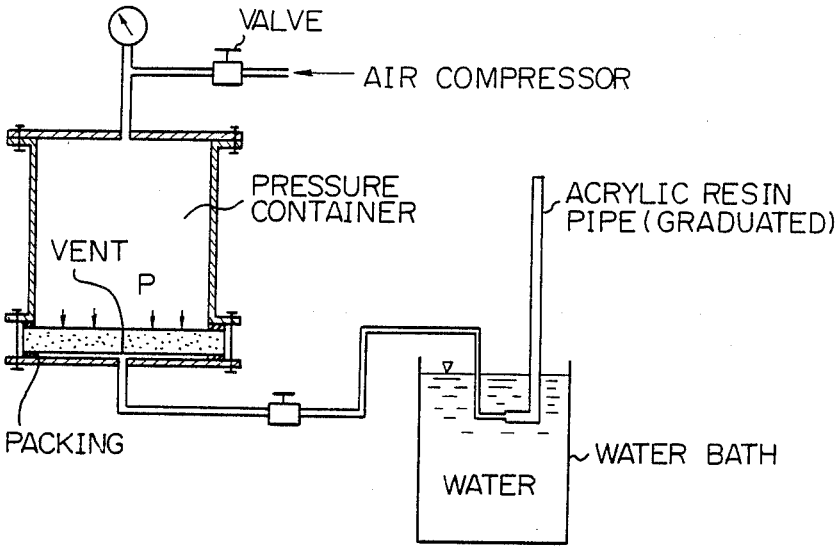
FIG. 2 is a schematic drawing of an apparatus for the gas permeation test.

(b) A gas permeation test was conducted using the apparatus of FIG. 2. The pressure inside a pressure container was increased to 1.5 kg/cm$^2$, using an air compressor and the amount of air which had passed through the vent was measured after 24 hours. Said pressure was kept constant during the test period. Said air amount was measured by collecting the air which had passed through the vent, in a graduated pipe made of an acrylic resin. The pipe had one closed end and, after having been filled with water, was kept vertically in a water bath with the closed end positioned up.

Figure 3:
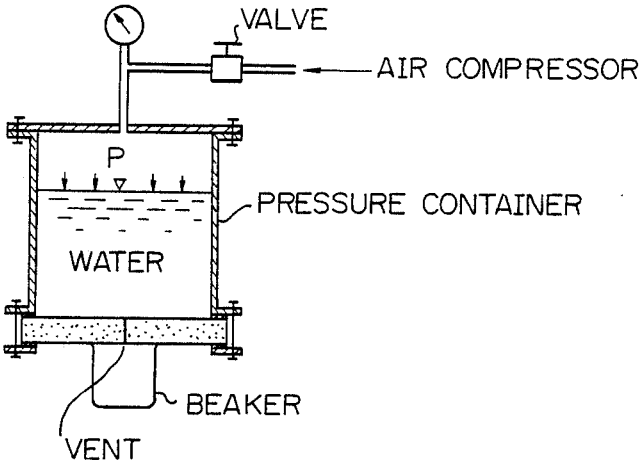
FIG. 3 is a schematic drawing of an apparatus for the water permeation test.

(c) A water permeation test was conducted using the apparatus of FIG. 3. Using an air compressor, compressed air was fed into a pressure container filled with water to a level of about ⅓ of the internal volume, whereby a pressure of 0.75 or 1.65 kg/cm$^2$G was applied to the water. The water which passed through the vent was stored in a beaker and its amount was measured after 100 hours.

(d) The number of vents used for each test was 3.

(C) Test results

The results of the gas permeation test and the water permeation test for the vents for 200- and 400-liter containers are shown in Table 2.

TABLE 2

| Vent | | Amount of gas permeated | Amount of water permeated (cc/100 hr) | |
|---|---|---|---|---|
| Dimension | No. | (cc/24 hr) | 0.75 kg/cm$^2$ | 1.65 kg/cm$^2$ |
| 3 × 3 × 38 | 1 | 1631 | 19.2 | 33.8 |
| mm (for | 2 | 1151 | 11.5 | 22.5 |
| 200 liters) | 3 | 1247 | 17.3 | 29.5 |
| | Average | 1343 | 16.0 | 28.6 |
| 3 × 3 × 45 | 1 | 972 | 10.8 | 20.2 |
| mm (for | 2 | 1418 | 13.5 | 27.3 |
| 400 liters) | 3 | 810 | 8.6 | 17.8 |
| | Average | 1067 | 11.0 | 21.8 |

As will be appreciated from Table 2, all of the tested ceramic vents for 200- and 400-liter containers satisfy the design capabilities. In the above capability test, the gas permeation coefficient and the water permeation coefficient are represented by the following formulas, respectively.

① Gas permeation coefficient (K)

$$K = \frac{2lp_2\gamma A}{p_1^2 - p_2^2} \cdot \frac{Q}{A}$$

$p_1$: load pressure (kg/cm$^2$)

$p_2$: atmospheric pressure (kg/cm$^2$)

l: length of sample (cm)

A: cross-sectional area of sample (cm$^2$)

γA: unit volume weight of air (1205×10$^{-6}$ kg/cm$^3$)

Q: amount of gas permeated (cm$^3$/sec)

② Water permeation coefficient (K)

$$K = \rho \cdot \frac{l}{p} \cdot \frac{Q}{A}$$

p: hydraulic pressure (kg/cm$^2$)

l: length of sample (cm)

A: cross-sectional area of sample (cm$^2$)

ρ: unit volume weight of water (1.0×10$^{-3}$ kg/cm$^3$)

Q: amount of water permeated (cm$^3$/sec)

(4) Test for confirmation of safety of vent after the vent has been subjected to a hydraulic pressure (A) Test purpose To confirm that the vent portion is not broken by a low hydraulic pressure. The water pressure used for the test was 7 kg/cm$^2$ which is higher than the pressure needed to break 200-liter containers by external hydraulic pressure.

(B) Test method (a) Sample

Figure 4:
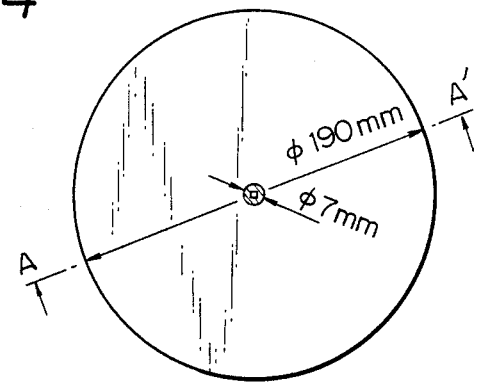
FIG. 4 is a plan view of a sample used for test confirmation regarding the safety of a vent when subjected to hydraulic pressure.
Figure 5:
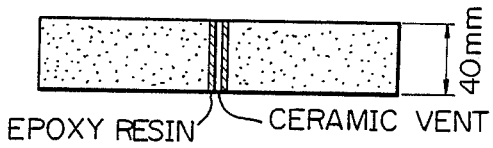
FIG. 5 is a sectional view of the sample of FIG. 4 taken along the A–A′ line of FIG. 4.
Figure 6:
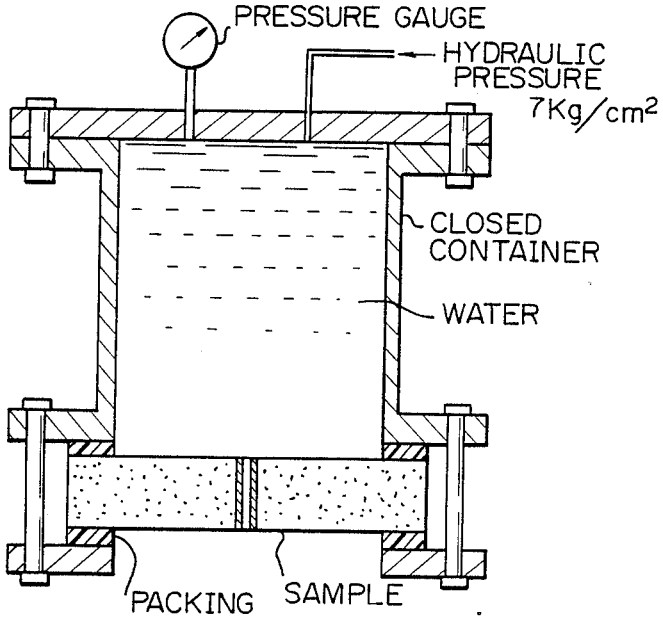
FIG. 6 is a schematic drawing of an apparatus for test confirmation regarding the safety of a vent incorporating the sample of FIG. 4.

The sample used was obtained by embedding a ceramic vent (3×3×40 mm) into a SFPIC circular plate of 190 mm (diameter)×40 mm (thickness) having, in the center, a hole 7 mm in diameter, with an epoxy resin. (Reference is made to FIGS. 4 and 5.)

(b) Test Procedure

The sample was tightly fixed to the lower portion of a closed container with bolts with packings placed between the container and the sample so as to prevent water leakage through the fixed portion. Then, the closed container was filled with water inside. Subsequently, a hydraulic pressure of 7 kg/cm$^2$ was applied to the sample for 10 minutes.

(C) Test results

The occurrence of any change in appearance of the ceramic vent was examined before and after the test, as well as the occurrence of slippage at the interfaces between the ceramic vent and the epoxy resin and between the epoxy resin and the SFPIC portion. However, no abnormality was seen at the ceramic vent itself nor at the portion of the sample at which the ceramic vent was fixed.

(5) Dropping test (A) Test purpose and test method (a) This test was conducted in order to confirm the strength of a vent in the face of being dropped, as well as the effect of the vent on the lid of a container to which the vent is fixed when the container itself is dropped.

(b) A 400-liter SFPIC container whose SFPIC lid had a vent was used. The container was dropped vertically from a height of 7.5 m with its upper portion facing down. The container had contained within it sand containing 1% free water.

(B) Test results (a) The vent experienced no damage due to the impact when dropped. Further, there was no slippage of the vent.

(b) The lid showed no damage due to the fixation of the vent, either. That is, no crack occurred at the portion of the lid at which the vent was fixed.

We claim:

1. A pressure-regulating device for impact-resistant containers used for storage, transportation and disposal of hazardous waste materials, which comprises a vent fixed to the lid of said container to keep the gaseous phase pressure inside said container at a positive pressure of 50% or less of the pressure resistance of said container, the vent being columnar and made of an alumina-based sintered ceramic and having a porosity of 50% or less, a pore diameter range of 0.4 to 1.4 $\mu$ and a length (mm)/cross-sectional area (mm$^2$) ratio of 2 to 10.

2. A pressure-regulating device according to claim 1 wherein the alumina-based sintered ceramic consists of 92 to 95% by weight of $Al_2O_3$, 4.5 to 7% by weight of $SiO_2$ with the balance consisting of other components.

3. A pressure-regulating device according to claim 1 wherein the cross-sectional shape of the columnar vent is selected from the group consisting of square, hexagonal, octagonal and circular.

4. A pressure-regulating device according to claim 2 wherein the cross-sectional shape of the columnar vent is selected from the group consisting of square, hexagonal, octagonal and circular.

* * * * *